US010844541B2

(12) United States Patent
Wu et al.

(10) Patent No.: US 10,844,541 B2
(45) Date of Patent: Nov. 24, 2020

(54) RELEASE AID

(71) Applicant: Ecolab USA Inc., St. Paul, MN (US)

(72) Inventors: Jia Wu, Wyndham Vale (AU); Yulin Zhao, Shanghai (CN); Xiao Zhang, Shanghai (CN)

(73) Assignee: ECOLAB USA INC., St. Paul, MN (US)

( * ) Notice: Subject to any disclaimer, the term of this patent is extended or adjusted under 35 U.S.C. 154(b) by 197 days.

(21) Appl. No.: 15/779,767

(22) PCT Filed: Nov. 29, 2016

(86) PCT No.: PCT/US2016/063934
§ 371 (c)(1),
(2) Date: May 29, 2018

(87) PCT Pub. No.: WO2017/095783
PCT Pub. Date: Jun. 8, 2017

(65) Prior Publication Data

US 2019/0055695 A1 Feb. 21, 2019

(30) Foreign Application Priority Data

Nov. 30, 2015 (CN) ..... 2015 1 0855299

(51) Int. Cl.

| | |
|---|---|
| ***D21H 17/15*** | (2006.01) |
| ***D21H 17/14*** | (2006.01) |
| ***D21H 21/14*** | (2006.01) |
| ***B31F 1/12*** | (2006.01) |
| ***D21H 25/00*** | (2006.01) |
| ***B31F 1/14*** | (2006.01) |
| ***D21H 21/06*** | (2006.01) |

(52) U.S. Cl.
CPC ..... *D21H 17/15* (2013.01); *B31F 1/12* (2013.01); *B31F 1/14* (2013.01); *D21H 17/14* (2013.01); *D21H 21/06* (2013.01); *D21H 21/14* (2013.01); *D21H 21/146* (2013.01); *D21H 25/005* (2013.01)

(58) Field of Classification Search
CPC ..... D21H 17/14; D21H 17/15; D21H 21/14; D21H 21/146; D21H 21/06; D21H 25/005; B31F 1/12; B31F 1/14
See application file for complete search history.

(56) References Cited

U.S. PATENT DOCUMENTS

| | | | | |
|---|---|---|---|---|
| 3,102,064 | A | 8/1963 | Wurzburg et al. | |
| 5,104,486 | A * | 4/1992 | Sweeney | D21H 17/16 162/158 |
| 5,658,374 | A | 8/1997 | Glover | |
| 5,944,954 | A | 8/1999 | Vinson et al. | |
| 6,146,494 | A | 11/2000 | Seger et al. | |
| 6,562,194 | B1 | 5/2003 | Archer et al. | |
| 7,829,600 | B1 | 11/2010 | Trksak et al. | |
| 8,029,966 | B2 * | 10/2011 | Kamiyoshi | G03G 9/09733 430/137.1 |
| 8,071,667 | B2 | 12/2011 | Furman, Jr. et al. | |
| 2006/0272787 | A1 | 12/2006 | Furman, Jr. et al. | |
| 2007/0102130 | A1 | 5/2007 | Satyavolu et al. | |
| 2015/0159329 | A1 | 6/2015 | Tan et al. | |

FOREIGN PATENT DOCUMENTS

| | | | | |
|---|---|---|---|---|
| CN | 1141984 | A | | 2/1997 |
| CN | 1176655 | A | | 3/1998 |
| CN | 1291246 | A | | 4/2001 |
| CN | 101184799 | A | | 5/2008 |
| CN | 104498160 | A | * | 4/2015 |
| CN | 106812019 | A | | 6/2017 |
| JP | 2005-076141 | A | | 3/2005 |
| WO | WO 01/15165 | A1 | | 3/2001 |
| WO | WO 01/74581 | A1 | | 10/2001 |
| WO | WO 2011/058086 | A1 | | 5/2011 |
| WO | WO 2012/094443 | A2 | | 7/2012 |
| WO | WO 2013/070542 | A1 | | 5/2013 |

OTHER PUBLICATIONS

Israel Patent Office, International Search Report in International Patent Application No. PCT/US2016/063934, 4 pp. (dated Jan. 31, 2017).

Israel Patent Office, Written Opinion in International Patent Application No. PCT/US2016/063934, 5 pp. (dated Jan. 31, 2017).

State Intellectual Property Office of the People's Republic of China, First Office Action in Chinese Patent Application No. 201510855299.3, 16 pp. (dated Nov. 16, 2017).

Wang et al., "Hydrogenation of maleic anhydride to succinic anhydride over $CeO_2$ modified Ni/γ-$Al_2O_3$ catalysts," *Industrial Catalysts*, 22(9), pp. 709-714 (Sep. 2014).

European Patent Office, Extended European Search Report in European Patent Application No. 16871342.8, 6 pp. (dated Apr. 11, 2019).

* cited by examiner

*Primary Examiner* — Anthony J Green
(74) *Attorney, Agent, or Firm* — Eric D. Babych; Barnes & Thornburg LLP

(57) ABSTRACT

The present invention relates to a release aid that includes at least one succinic anhydride derivative for use in a papermaking process. For example, the release aid of the present invention is particularly useful for use in a paperweb creping process. The present invention also relates to a paperweb creping method that includes a release aid comprising at least one succinic anhydride.

15 Claims, 1 Drawing Sheet

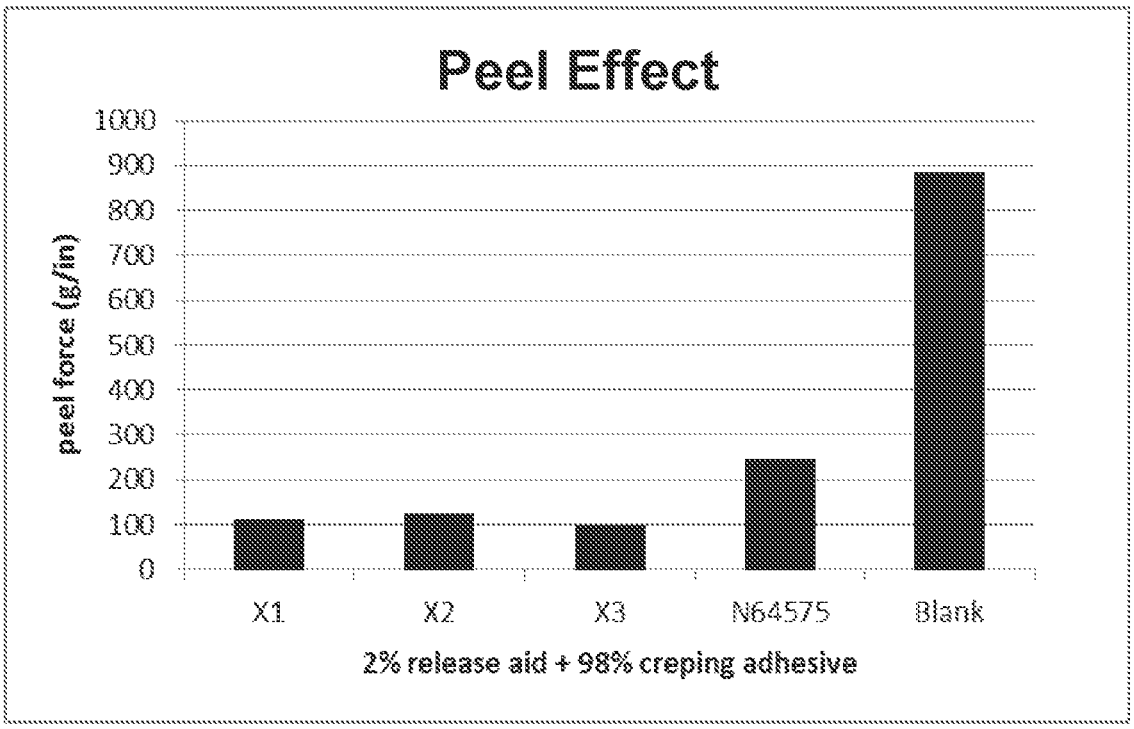
Peel Effect
1000
900
800
700
600
500
400
300
200
100
0
peel force (g/in)
X1
X2
X3
N64575
Blank
2% release aid + 98% creping adhesive

RELEASE AID

CROSS-REFERENCE TO RELATED APPLICATION APPLICATIONS

This patent application is a national phase application of International Patent Application Serial No. PCT/US2016/063934, filed Nov. 29, 2016, which itself claims priority to Chinese Patent Application No. 201510855299.3, filed Nov. 30, 2015, each disclosure of which is incorporated by reference in its entirety.

BACKGROUND OF THE INVENTION

In the paper making process, such as manufacture of some paper products like facial tissue, bathroom tissue or paper towels, the paperweb is conventionally subjected to a creping process in order to impart desirable characteristics, such as softness, bulk, strength, and absorbency. The creping process involves adhering the paperweb to a rotating creping apparatus, such as an apparatus known as a Yankee dryer, creping and then dislodging the adhered paperweb from the dryer with a doctor blade. In order to facilitate uniform release of the paperweb from the dryer, a release aid is sprayed onto the cylinder. This release aid assists in the uniform release of the paperweb, and also lubricates and protects the blade from excessive wear.

Release aids, in particular oil-based release aids, are widely used in papermaking processes. Traditional oil-based release aids comprise a hydrocarbon oil or natural oil as main components. The hydrocarbon oils are usually derived from the petroleum distillation process with various purities, while the natural oils are derived from vegetable oils such as soybean oil, corn oil, olive oil, and the like. By selecting different grade/source of oils with a suitable surfactant package, oil-based release aids with different release performances can be formulated.

However, in recent years, due to the continuous price increase of crude oils globally, the cost of oil-based release aids has largely increased. This is one of the biggest challenges for oil-based release aid development. Due to the hydrophobic nature of petroleum-based oils, the oil in the final tissue and/or towel paper products can cause a reduction in absorbency, i.e., the ability of final paper products to absorb water or aqueous solutions may be impaired. A great deal of effort has been made towards formula optimization of the existing oil-based release aids. On one hand, more suitable raw material qualifications are being evaluated for main components like oil and surfactants in existing products. On the other hand, a fine tuning of existing formulae has been tried to further reduce the total cost.

CN101184799A discloses a release aid comprising one or more (poly)$C_5$-$C_{20}$ alpha-olefins and one or more surfactants. The use of the synthetic oil PAO in release formulations improved the papermaking application in terms of effectiveness and efficiency and provided release of tissue from through-air drying (TAD) fabrics. The surfactants were selected from fatty acids, alkoxylated alcohols, alkoxylated fatty acids, sucrose and glucose esters and derivatives thereof and polyethylene glycols and mixtures thereof.

In addition, some non-oil-based release aid products have been developed by changing the composition of release aids in papermaking processes. For example, WO01/74581A1 discloses a non-oil-based release aid useful in a creping process for releasing a paperweb from a Yankee dryer, where the release aid was a non-oil-based chemical compound represented by the following formula: $R—(OC_3H_6)_y(OC_2H_4)_zOH$. The non-oil based chemical compounds included, for example, alkoxylated alkylphenols, alkoxylated fatty acids, alkoxylated alcohols, and the like. In addition, the release aid may optionally comprise 0 to about 20% by weight of one or more emulsifying surfactants.

CN1176655A discloses a lecithin-based aqueous release aid composition comprising a stable emulsion consisting of an alcohol, a fatty acid or an oil, lecithin, a water-soluble or water-dispersible surfactant, and water. By using a fatty acid, an oil and the like as solvents for lecithin in this composition, a good dispersion of lecithin was achieved.

Furthermore, WO2011/058086 discloses a paper making process including applying a release agent comprising a $C_{16}$-$C_{20}$ fatty acid or salt thereof to the surface of the heated cylinder. It is suggested in this reference that the release agent comprises about 2 to about 50% $C_{16}$-$C_{20}$ fatty acid or salt thereof; about 5 to about 50% alcohol; about 0 to about 75% oil; about 1 to about 5% surfactant and about 1 to about 50% water.

BRIEF SUMMARY OF THE INVENTION

It has surprisingly been found that, if at least one succinic anhydride derivative is used in a release aid formulation, the resulting release aid will not only have a low cost, but also lead to a better release performance than traditional release aids. The release aid composition of the present invention is particularly suitable for use as a release aid in paperweb creping applications, and as a fabric release agent to release the paperweb from the fabrics used in the manufacture thereof.

Thus, a first aspect of the present invention provides a release aid used in a paperweb creping process, comprising an active ingredient containing at least one succinic anhydride derivative.

A second aspect of the present invention provides a novel paperweb creping method.

A third aspect of the present invention relates to the use of succinic anhydride derivatives for creping paperweb in a paper making process.

Other aspects and modifications and other advantages of the present invention can become apparent from the following detailed descriptions of the specification and the annexed claims.

BRIEF DESCRIPTION OF THE DRAWING

The FIGURE is a comparison of the peel effects of various release aids under the same testing conditions according to Comparative Example 1.

DETAILED DESCRIPTION OF THE INVENTION

The terms "tissue paperweb, paperweb, web, paper sheet, sheet and paper product" all refer to sheets of paper made by a process comprising steps of forming an aqueous papermaking furnish; depositing this furnish onto a foraminous surface, such as a Fourdrinier wire, and removing water from the furnish either by gravity or vacuum-assisted drainage. In the final step of the process, the desirable textural characteristics are imparted to the paper by means of TAD fabric or creping, or a combination thereof, and the sheet is dried. An example of a paper machine and a papermaking process that may be used in the invention is disclosed, for example, in U.S. Pat. No. 5,944,954 and WO2013070542, which are incorporated herein in their entirety by reference.

In certain embodiments, the present invention is used in a tissue making process comprising preparing a slurry of fibers, forming a tissue web on a Fourdrinier wire, dewatering the tissue web in a pressing section, and creping the tissue web against a creping cylinder (e.g., Yankee dryer) using a flexible blade (e.g., creping or doctor blade). In certain embodiments, the present invention can be used to prepare a single ply or a multi-ply tissue or paper towel. However, it is to be understood that the release aid of the invention can be used in other known papermaking processes and in other known paper machines for manufacturing tissue and/or towel paper products.

The tissue may be comprised of various types of natural and synthetic fibers including wood pulps of chemical and mechanical types, vegetable fibers, recycled fibers and synthetic fibers such as polypropylene. The tissue may also be comprised of particulate fillers, such as kaolin clay, titanium dioxide, and/or calcium carbonate.

Throughout the entire specification, the term "Composition" is comprised of at least one component or ingredient, particularly including the release aid, concentrate, solution, emulsion and the like recited herein.

All percentages, ratios and proportions herein are by weight unless otherwise specified.

The release aid and emulsion or solution thereof according to the present invention comprises active ingredient as its main effective component. "Active ingredient" herein refers to the ingredient that plays a decisive role in the release performance. In the prior art, for example, CN1176655A, WO0174581, CN101184799, U.S. Pat. Nos. 6,562,194, 8,071,667 and JP2005076141, it is also mentioned that the release aid, in addition to active ingredients, may generally comprise surfactants to assist the active ingredients to form a stable emulsion or dispersion. Such surfactants differ from the active ingredients, and generally are, for example, fatty acids, alkoxylated fatty acids, alkoxylated alcohols, alkoxylated alkylphenols, sulfates and sulfonates of oils and fatty acids, sucrose and glucose esters and derivatives, as well as aliphatic esters, ethoxylated aliphatic esters and glycerol esters and the like. In principle, the surfactants and the specific examples mentioned in these references are also applicable to the present invention, and thus these references are incorporated herein in their entirety by reference.

A first aspect of the present invention provides a release aid used in paperweb creping process, comprising an active ingredient containing at least one succinic anhydride derivative.

The succinic anhydride derivative according to the present invention is selected from groups consisting of succinic anhydrides having the structural formula I or II and the corresponding salts thereof:

I

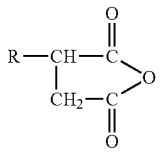

II

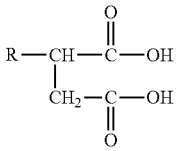

wherein R is an alkyl moiety or an alkenyl moiety having from 8 to 25 carbon atoms. In certain embodiments, R is an alkyl moiety or an alkenyl moiety having from 10 to 22 carbon atoms. In certain embodiments, R is an alkyl moiety or an alkenyl moiety having from 15 to 20 carbon atoms. In certain embodiments, R is an alkyl moiety. In certain embodiments, the succinic anhydride derivative is a succinic acid, succinic anhydride, or a succinate salt.

In certain embodiments, it is possible to use monosalts or disalts formed by succinic anhydrides as described above and monovalent or divalent cations. Examples of suitable monovalent or divalent cations are $Na^+$, $K^+$, $NH_4^+$, $Mg^{2+}$, $Ca^{2+}$. In certain embodiments, the monovalent or divalent cations are $Na^+$, $K^+$ and $NH_4^+$. In certain embodiments, the succinic anhydride derivatives are succinate salts. In certain embodiments, the succinic anhydride derivatives are monosalts or disalts formed by succinic anhydride derivatives of formula II with monovalent cations such as $Na^+$, $K^+$ and $NH_4^+$. In certain embodiments, the succinic anhydride derivatives are disalts.

In certain embodiments, a succinic anhydride derivative or salt thereof is water soluble. In certain embodiments, at least about 1,000 mg of a succinic anhydride derivative or salt thereof is soluble in about 1 liter of water at 25° C.

In certain embodiments, during formation of disalts from succinic anhydride derivatives, two carboxyl groups can be bonded with the same or different monovalent cations, or with divalent cations. In certain embodiments, during formation of monosalts from succinic anhydride derivatives, the other free carboxyl group can further form an ester bond with appropriate hydrocarbon groups like alkyl. In certain embodiments, the succinic anhydride having an ester bond is water soluble. In certain embodiments, at least about 1,000 mg of a succinic anhydride derivative having an ester bond is soluble in about 1 liter of water at 25° C.

Nonlimiting examples of succinic anhydride derivatives are lauryl succinic acid or succinic anhydride, pentadecyl succinic acid or succinic anhydride, hexadecyl succinic acid or succinic anhydride, hexadecenyl succinic acid or succinic anhydride, octadecyl succinic acid or succinic anhydride, octadecenyl succinic acid or succinic anhydride, dipotassium or disodium hexadecyl succinate, dipotassium or disodium octadecyl succinate, dipotassium or disodium hexadecenyl succinate as well as dipotassium or disodium octadecenyl succinate.

In certain embodiments, the succinic anhydride derivative according to the present invention is used alone or in combination with one or more active ingredients in the release aid.

The succinic anhydride derivatives according to the present invention may be prepared in virtue of the methods or technologies known to the skilled person in the art, e.g. referring to "Hydrogenation of maleic anhydride to succinic anhydride over $CeO_2$ modified Ni/γ-$Al_2O_3$ catalysts", INDUSTRIAL CATALYSIS, Vol. 22 No. 9, Sep. 2014.

In certain embodiments, the release aid is a stable aqueous composition comprising active ingredients containing the aforesaid at least one succinic anhydride derivative, a water-soluble or water-dispersible surfactant and water. In certain embodiments, the aqueous composition consists of active ingredients containing the aforesaid at least one succinic anhydride derivative, a water-soluble or water-dispersible surfactant and water. The aqueous composition can be a stable aqueous emulsion or a stable aqueous solution. In case of a stable aqueous solution, the composition can comprise an appropriate amount of a pH regulator such as NaOH, in addition to the active ingredient containing at least one succinic anhydride derivative, a water-soluble or water-dispersible surfactant and water.

In another embodiment, if necessary, the release aid can also be a stable concentrate composition, comprising the aforesaid active ingredient containing at least one succinic anhydride derivative, and a water-soluble or water-dispersible surfactant. In certain embodiments, the stable concentrate composition consists of the aforesaid active ingredient containing at least one succinic anhydride derivative, and a water-soluble or water-dispersible surfactant.

Thus, in certain embodiments, the release aid may consist of said at least one succinic anhydride derivative, a water-soluble or water-dispersible surfactant and water and optionally a pH regulator.

In certain embodiments, the release aid composition according to the present invention may also comprise other active ingredients including, for example, white oil, fatty acids, lecithin, alkoxylated alkylphenols, alkoxylated fatty acids and (poly)$C_5$-$C_{20}$ alpha-olefins. It should be appreciated that these other active ingredients are optionally added provided that they do not negatively affect the homogeneity and stability of products. Therefore, the proportion of the succinic anhydride derivatives may range from about 1 to 100% by weight, such as 1 to 99% by weight, 1 to 95% by weight, 10 to 95% by weight, 20 to 95% by weight, 35 to 95% by weight, 50 to 95% by weight or 60 to 95% by weight, based on the total weight of all active ingredients.

In certain embodiments, the surfactant is a water-soluble or water-dispersible surfactant, which can be nonionic, cationic, anionic, amphoteric or zwitterionic surfactants. Nonlimiting examples of surfactants include, for example, sorbitan fatty acid esters, such as sorbitan monooleate or sorbitan monolaurate, polyoxyethylene sorbitan fatty acid esters such as fatty acid esters and laurate esters, alkoxylated alcohols, other fatty acids, alkoxylated fatty acids, alkoxylated alkylphenols, sulfates and sulfonates of oils and fatty acids, sucrose and glucose esters and derivatives thereof, as well as aliphatic esters, ethoxylated aliphatic esters and glycerol esters and the like. In certain embodiments, water-soluble or water-dispersible surfactants are nonionic surfactants, for example, sorbitan fatty acid esters, polyoxyethylene sorbitan fatty acid esters, alkoxylated alcohols and the like. In certain embodiments, the polyoxyethylene sorbitan fatty acid esters can be Tween 20, Tween 40, Tween 60 and Tween 80, while the sorbitan fatty acid esters can be Span 20, Span 40, Span 60 and Span 80. In certain embodiments, an alkoxylated alcohol or ethoxylated alcohol with about 3 to 15 EO groups is used. In certain embodiments, a fatty alcohol polyoxyethylene ether is used.

As for the water-based release aid composition according to the present invention, including emulsion or solution composition, the total proportion of at least one succinic anhydride derivative and the surfactant can be set within the scope from 1% to 99% by weight and the water component can be added in an amount from 1% to 99% by weight. In certain embodiments, the water component can be added in an amount from 50% to 90% by weight. In certain embodiments, the release aid concentrate composition comprises less than 1% by weight of water. In certain embodiments, the release aid concentrate composition is essentially free of water. In addition, in the water-based release aid composition and the release aid concentrate composition, in certain embodiments, the weight ratio of said at least one succinic anhydride derivative to the surfactant is 1:(0.05 to 20). In certain embodiments, the weight ratio of said at least one succinic anhydride derivative to the surfactant is 1:(0.5 to 10). In certain embodiments, the weight ratio of said at least one succinic anhydride derivative to the surfactant is 1:(0.5 to 5).

The water-based release aid composition is prepared by adding water proportionally into the premixed mixture of the active ingredient containing succinic anhydride derivative and surfactant system, e.g., the release aid concentrate composition as described above. An emulsion with a certain range of particle size could be prepared from the water-based release aid formulation by adjusting the ratio of the water component and the surfactant.

Generally, the water-based composition will result in higher quality of coating film on the hot plate.

A second aspect of the present invention provides a novel method of creping a paperweb, comprising the steps of:

a) applying the release aid composition comprising the active ingredient containing at least one succinic anhydride derivative as described above to a rotating creping cylinder;

b) pressing the paperweb against the creping cylinder for effective adhesion of the paperweb to the creping cylinder; and c) dislodging the paperweb from the creping cylinder with a doctor blade.

In certain embodiments, the succinic anhydride derivative provides an increase in adhesion when compared to an identical method having no succinic anhydride derivative.

In the method of creping a paperweb according to the instant invention, the release aid can be usually applied to the creping cylinder in conventional wet press machines.

In certain embodiments, about 1 to 40 $mg/m^2$ of the release aid described herein is applied to the creping cylinder. As used herein, $mg/m^2$ refers to the amount of succinic anhydride derivative/surfactant mixture measured in milligrams relating to the surface area of the cylinder surface to which it is applied.

The release aid composition may be applied to the creping cylinder by any suitable means, for example by spraying, to achieve uniform application of the formulation onto the cylinder. In certain embodiments, the release aid is sprayed onto a creping cylinder (e.g., Yankee dryer) using one or more spray booms. In certain embodiments, the release aid is sprayed onto a Yankee dryer as an aqueous solution or mixture prior to transfer of semi-dry tissue web.

In an embodiment, an adhesive that is also in aqueous form is applied to the Yankee dryer along with the release aid.

In certain embodiments, the release aid comprises a water-soluble, cationic polyamide-epihalohydrin (PAE) resin. The PAE resin comprises the reaction product of an epihalohydrin and a long chain polyamide containing secondary amine groups. With respect to other facets of PAE resin and some other feasible and available creping adhesives, the specification of CN101184799A may be referred to, see e.g., from line 1 page 7 to line 10 page 8 and the references cited therein. Here, CN101184799A is incorporated in the instant application in its entirety by reference.

The release aid composition of this invention may also be used in combination with functional additives used in the art to improve softness of tissue or towel. Representative functional additives include those illustrated in the 3rd paragraph on page 8 of the specification of cited CN101184799A.

A third aspect of the present invention relates to use of succinic anhydride derivative for creping paper web in a papermaking process.

In certain embodiments, a release aid comprising a succinic anhydride derivative is applied to (e.g., sprayed onto) the surface of a Yankee dryer. In certain embodiments, the creping process comprises applying a release aid comprising an active ingredient comprising at least one succinic anhydride derivative to the Yankee dryer, pressing the paperweb against the Yankee dryer, and dislodging the paperweb from the Yankee dryer with a creping blade. In certain embodiments, the succinic anhydride derivative is used in a process to form a tissue paper or paper towel.

The following examples further illustrate the invention but, of course, should not be construed as in any way limiting its scope.

EXAMPLES

The following examples are presented for purposes of illustration and are not intended to limit the scope of the invention.

Reagents Used in Examples:

A: alkyl succinic anhydride with alkyl chain having 18 carbon atoms, octadecyl succinic anhydride B: alkyl succinic acid with alkyl chain having 18 carbon atoms, octadecyl succinic acid C: disodium alkyl succinate with alkyl chain having 16 carbon atoms, disodium hexadecyl succinate D: white oil E: tall oil fatty acid F: water G: Tween-80, polyoxyethylene sorbitan monooleate H: fatty alcohol polyoxyethylene ether, AEO-5

I: 48% NaOH solution

Peeling Force Test Method

A release aid and a creping adhesive are mixed in a given proportion. The resulting mixture (3-5 mL) is taken and deposited on a surface-polished iron plate of 10 cm×20 cm in size, and then heated to 100° C. for film formation. A cotton cloth strip of 5 cm in width is immersed in water, then spread onto the iron plate and adhesively compressed. After being kept in 105° C. oven for 15 minutes, the force required for peeling the cloth strip at an angle of 180° from the iron plate is tested using a tensile tester. The more this force decreases, the better the peeling effect of the corresponding release aid is.

Example 1

Release Aid Composition in the Form of an Emulsion

| Composition | % by weight |
|---|---|
| A | 5% |
| E | 5% |
| G | 10% |
| F | 80% |

About 5 g of A, about 5 g of E and about 10 g of G were weighed and added in a vessel. Then, the mixture was stirred at a rate of 300 RPM until a uniform liquid phase was formed. Under stirring, about 80 g of F was added slowly to the mixture forming a uniform and stable pale yellow emulsion.

Example 2

Release Aid Composition in the Form of a Solution

| Composition | % by weight |
|---|---|
| B | 3% |
| C | 2% |
| H | 15% |
| F | 79.9% |
| I | 0.1% |

About 3 g of B, about 2 g of C and about 15 g of H as well as about 80 g of F were mixed and stirred till complete mixing, to which a small amount of I was then added to adjust the pH of the mixture to 7.5-9.0. After stirring for a while, a transparent pale-yellow solution was formed.

Example 3

Release Aid Composition in the Form of a Concentrate

| Composition | % by weight |
|---|---|
| B | 40% |
| D | 5% |
| E | 5% |
| G | 50% |

About 40 g of B, about 5 g of D, 5 g of E and 50 g of G were weighed and added in a vessel. Then, the mixture was stirred at a rate of 300 RPM until a uniform liquid phase was formed.

Comparative Example 1

Various Release Aids:

Release aid Nalco 64575: commercially available conventional oil-based release aid 20% emulsion type release aid (X1) was prepared analogously to Example 1, wherein the ratio of A to G was about 1:2 (5%:10%).

20% solution type release aid (X2) was prepared analogously to Example 2, wherein the ratio of (B+C) to H was about 1:3 (5%:15%).

Concentrate type release aid (X3) was prepared analogously to Example 3, wherein the ratio of B to (E+G) was about 1:1.4 (40%:55%), and was diluted by water to the concentration of 20% prior to application.

Creping Adhesive:

Nalco 64094: PAE Adhesive

The creping adhesive and four release aids described above are formulated to four mixed solutions respectively according to the proportion of 98% adhesive to 2% each release aid. The peeling forces of different release aids were tested using the above peel force test method under the same testing conditions.

Peel effects are shown in the FIGURE. "Blank" referred to only creping adhesive without any release aid, and the concentration of creping adhesive therein was the same as other samples while the portion corresponding to release aids of other samples was replaced with water. As seen from the FIGURE, under the same testing conditions, the release aid containing succinic anhydride derivatives according to the present invention enabled the peeling force to decrease the most, thereby resulting in better peel performance compared to the existing product N64575.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Embodiments of this invention are described herein, including the best mode known to the inventors for carrying out the invention. Variations of these embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A release aid comprising an active ingredient comprising at least one succinic anhydride derivative, the succinic anhydride having the structural formula I or II or a salt thereof,

I

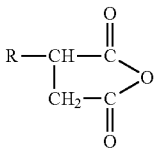

-continued

II

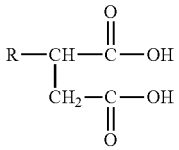

wherein R is an alkyl moiety or an alkenyl moiety having from 8 to 25 carbon atoms, wherein the release aid is a stable aqueous composition comprising the at least one succinic anhydride derivative, a water-soluble or water-dispersible surfactant, and water, wherein the surfactant is a sorbitan fatty acid ester, polyoxyethylene sorbitan fatty acid ester, alkoxylated alcohol, or a combination thereof, and wherein the total proportion of the succinic anhydride derivative and the surfactant is from 1% to 99% by weight and the proportion of water is from 1% to 99% by weight and wherein the weight ratio of the at least one succinic anhydride derivative to the surfactant is 1:0.05 to 1:20.

2. The release aid of claim 1, wherein R is an alkyl moiety or an alkenyl moiety having from 10 to 22 carbon atoms.

3. The release aid of claim 1, wherein R is an alkyl moiety or an alkenyl moiety having from 15 to 20 carbon atoms.

4. The release aid of claim 1, wherein the succinic anhydride derivative is selected from monosalts or disalts formed by the succinic anhydrides of formula I or II and monovalent or divalent cations.

5. The release aid of claim 4, wherein the succinic anhydride derivative is a disalt.

6. The release aid of claim 4, wherein the monovalent or divalent cations are selected from $Na^+$, $K^+$, $NH_4^+$, $Mg^{2+}$, and $Ca^{2+}$.

7. The release aid of claim 6, wherein the monovalent or divalent cations are selected from $Na^+$, $K^+$ and $NH_4^+$.

8. The release aid of claim 1, wherein the succinic anhydride derivative is lauryl succinic acid, lauryl succinic anhydride, pentadecyl succinic acid, pentadecyl succinic anhydride, hexadecyl succinic acid, hexadecyl succinic anhydride, hexadecenyl succinic acid, hexadecenyl succinic anhydride, octadecyl succinic acid, octadecyl succinic anhydride, octadecenyl succinic acid, octadecenyl succinic anhydride, dipotassium hexadecyl succinate, disodium hexadecyl succinate, dipotassium octadecyl succinate, disodium octadecyl succinate, dipotassium hexadecenyl succinate, disodium hexadecenyl succinate, dipotassium octadecenyl succinate, disodium octadecenyl succinate, or a combination thereof.

9. The release aid of claim 1, wherein the release aid is a stable aqueous emulsion, a stable aqueous solution, or a stable concentrate.

10. The release aid of claim 1, wherein the release aid further comprises a fatty acid, lecithin, alkoxylated alkylphenol, or (poly)$C_5$-$C_{20}$ alpha-olefin.

11. The release aid of claim 1, wherein the release aid further comprises an alkoxylated fatty acid.

12. The release aid of claim 1, wherein the weight ratio of the at least one succinic anhydride derivative to the surfactant is 1:0.5 to 1:10.

13. The release aid of claim 1, wherein the weight ratio of the at least one succinic anhydride derivative to the surfactant is 1:0.5 to 1:5.

14. The release aid of claim 1, wherein the release aid consists of the at least one succinic anhydride derivative, a water-soluble or water-dispersible surfactant, water, and a pH regulator.

15. A method of creping a paperweb, the method comprising:

a) applying the release aid of claim 1 to a rotating creping cylinder;

b) pressing the paperweb against the creping cylinder for effective adhesion of the paperweb to the creping cylinder; and c) dislodging the paperweb from the creping cylinder with a doctor blade.

* * * * *